US006672532B1

(12) United States Patent
Huang

(10) Patent No.: US 6,672,532 B1
(45) Date of Patent: Jan. 6, 2004

(54) APPARATUS OF TAPE DISPENSER TO PREVENT TAPE ROLL ROTATING BACKWARDS

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 0 days.

(21) Appl. No.: 10/225,164

(22) Filed: Aug. 22, 2002

(51) Int. Cl.[7] ..... B65H 16/06; B65H 35/07

(52) U.S. Cl. ..... 242/588.6; 225/65; 225/66

(58) Field of Search ..... 242/588, 580, 242/588.3, 588.6, 402, 405, 422.4; 225/56, 57, 58, 59, 77, 61, 62, 65, 66, 47; 206/409, 408, 411

(56) References Cited

U.S. PATENT DOCUMENTS 2,664,252 A * 12/1953 Glew ..... 225/66
2,731,084 A * 1/1956 Burns ..... 225/65
3,155,301 A * 11/1964 Kusek ..... 225/66
3,173,591 A * 3/1965 Sax et al. ..... 225/66
4,358,328 A * 11/1982 Pearson ..... 225/65
4,961,525 A * 10/1990 Corbo et al. ..... 225/65
4,998,655 A * 3/1991 Huang ..... 225/47
5,820,005 A * 10/1998 Perkitny et al. ..... 225/65
6,216,978 B1 * 4/2001 Rodriguez ..... 242/588.6

* cited by examiner

*Primary Examiner*—William A. Rivera
(74) *Attorney, Agent, or Firm*—Bacon & Thomas, PLLC

(57) ABSTRACT

A tape dispenser. The dispenser includes a main body having a connecting board, two side arms at opposite ends of the connecting board respectively, two roll mounts at interior sides of the side arms respectively, four guiding pieces at interior sides of the side arms and below the connecting board and a cutting portion at exterior side of the side arm. A tape roll can be installed at between the side arms by inserting the roll mounts into a central hole of the tape roll. Each roll mount is provided with two stop arms extended substantially parallel to the rotating axis of the tape roll, which has a free end and a block on the exterior side thereof. The blocks are pressed by the tape roll to make the stop arms bent so that they will provide a friction to the tape roll, and a cutter is mounted on the connecting board for cutting a tape of the tape roll off.

12 Claims, 5 Drawing Sheets

APPARATUS OF TAPE DISPENSER TO PREVENT TAPE ROLL ROTATING BACKWARDS

FIELD OF THE INVENTION

The present invention relates to a packing tool, and more particularly to a tape dispenser, which can prevent tape roll rotating backwards.

BACKGROUND OF THE INVENTION

FIG. 1 shows a conventional tape dispenser 90 mainly comprising a connecting board 91, two side arms 92 at the opposite ends of the connecting board 91, two annular roll mounts 93 at the interior sides of the side arms 92 respectively and a cutter 94 at front end of the connecting board 91.

In use, a tape roll 50 is installed to the tape dispenser 90 between the side arms 92 with the roll mounts 93 inserted into the opposite ends of a central hole of the tape roll 50 for free rotation. The tape of the tape roll 50 is drawn out to the front side of the connecting board 91 to adhere to something and the cutter 94 can be used to cut the tape off.

Sometimes when the cutter 94 cuts the tape off, tension of the tape will make the tape roll 50 rotate backwards and cause the tail of the tape to run back on the tape roll 50. The tape roll 50 may also rotate backwards because of its own weight or by an unexpected force. These events cause inconvenience to the user when the tape dispenser is next used.

SUMMARY OF THE INVENTION

The primary object of the present invention is to provide a tape dispenser, which can prevent tape roll rotating backwards in unexpected situation to draw the tape back.

According to the object of the present invention, a tape dispenser comprises a main body having a connecting board, two side arms at opposite ends of the connecting board respectively and two roll mounts at interior sides of the side arms respectively for installing a tape roll between the side arms and inserting the roll mounts into a central hole of the tape roll. The roll mount is provided with at least a stop arm extended substantially parallel to the rotating axis of the tape roll, which has a free end to be pressed by the tape roll to provide a friction to the tape roll, and a cutting means for cutting a tape of the tape roll off.

DETAIL DESCRIPTION OF THE INVENTION

Figure 1:
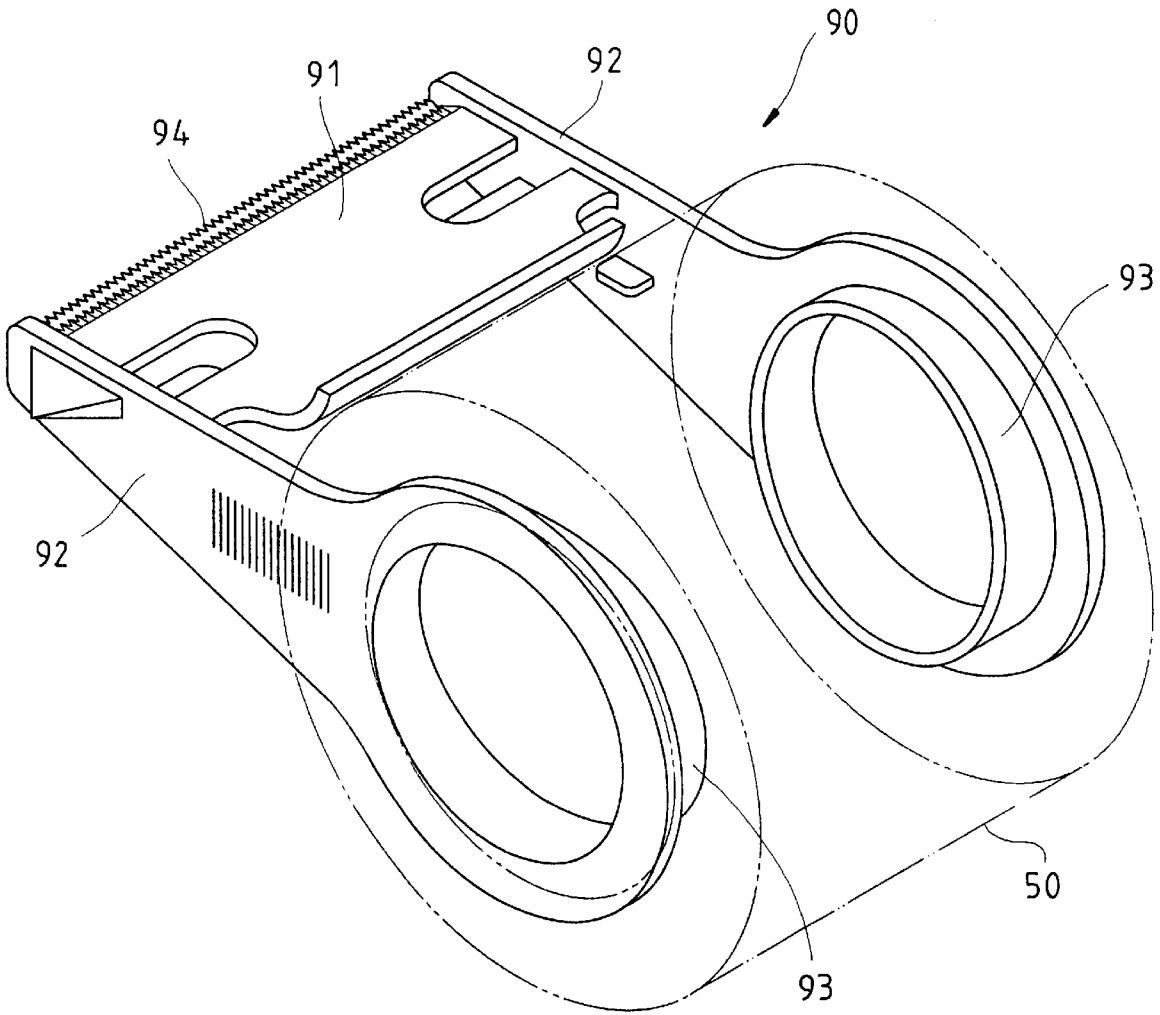
FIG. 1 PRIOR ART
FIG. 1 is a perspective view of a conventional tape dispenser.

Please refer to FIGS. 2–5, the preferred embodiment of the present invention provides a tape dispenser 10, which comprises a main body 10 made from plastics injection molding and having a connecting board 11, two side arms 12 and 13, two roll mounts 14, four guiding pieces 15 and 16 and a cutting portion 17.

The side arms 12 and 13 are connected with the connecting board 11 at its opposite ends respectively. The side arms 12 and 13 are flexible to bend their back ends. The roll mounts 14 are annular ribs disposed at the interior sides of the side arms 12 and 13 respectively to install a tape roll 50 thereon. The guiding pieces 15 and 16 are disposed at the interior sides of the side arms 12 and 13 below the connecting board 11. The cutting portion 17 is a triangular piece to cut the package off.

Each of the roll mounts 12 and 13 has two stop arms 18 parallel to the rotating axis of the tape roll 50. The stop arms 18 are made from disposing gaps 141 on the roll mounts 12 and 13 to form the stop arm 18 between two gaps 141 so that each stop arm 18 has a free end and is flexible. Each stop arm 18 has a block 181 at the exterior side and closing to the free end thereof.

A cutter 20 is mounted on the connecting board 11. The cutter is a metal piece in the present preferred embodiment having a saw edge. The connecting board 11 is disposed with pins 111 to be inserted into openings 21 on the cutter 20. Hot pressing the pins 111 to deform them and the pins 11 can secure the cutter 20 on the connecting board 11.

Figure 2:
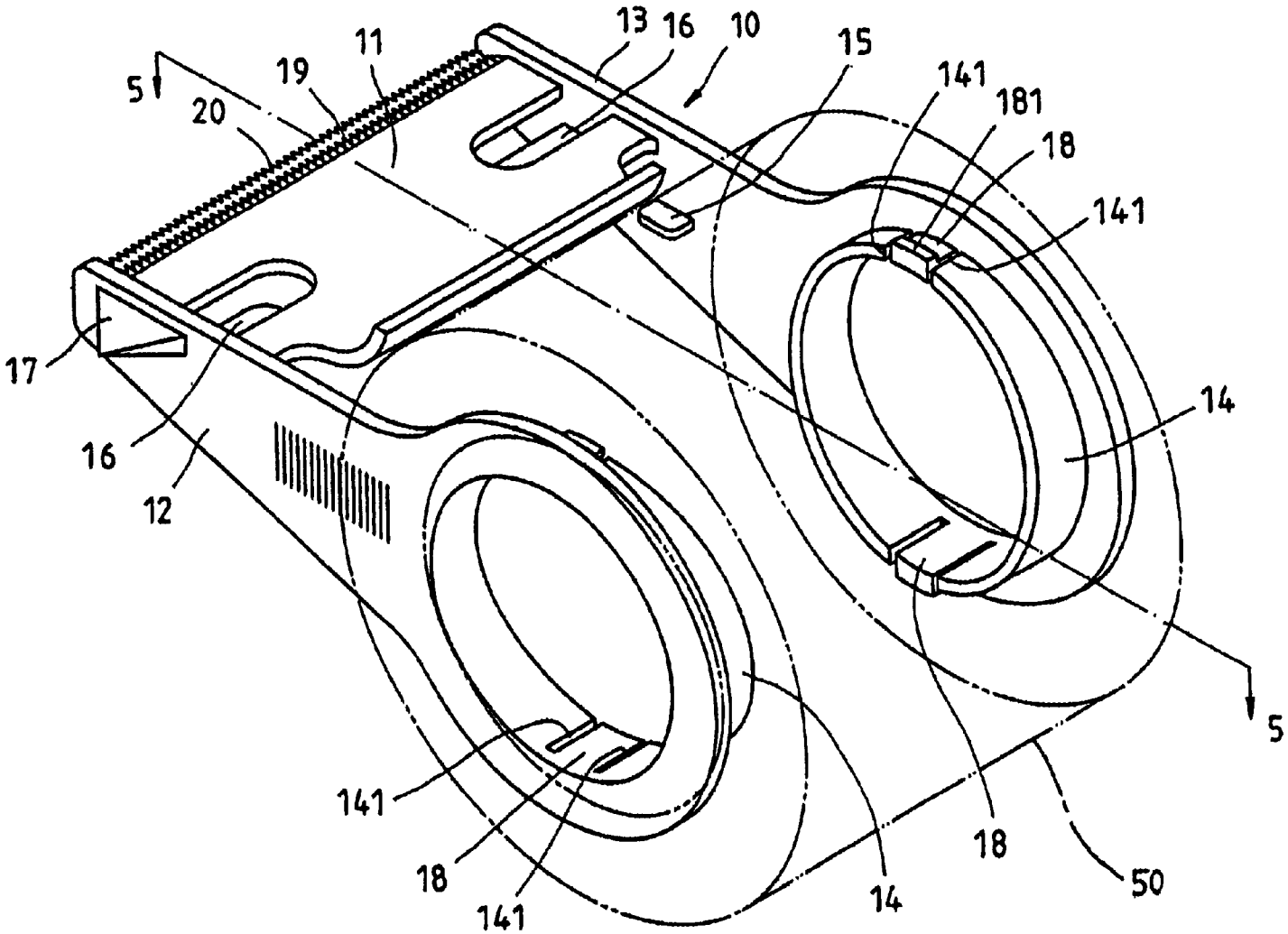
FIG. 2 is a perspective view of a preferred embodiment of the present invention.
Figure 3:
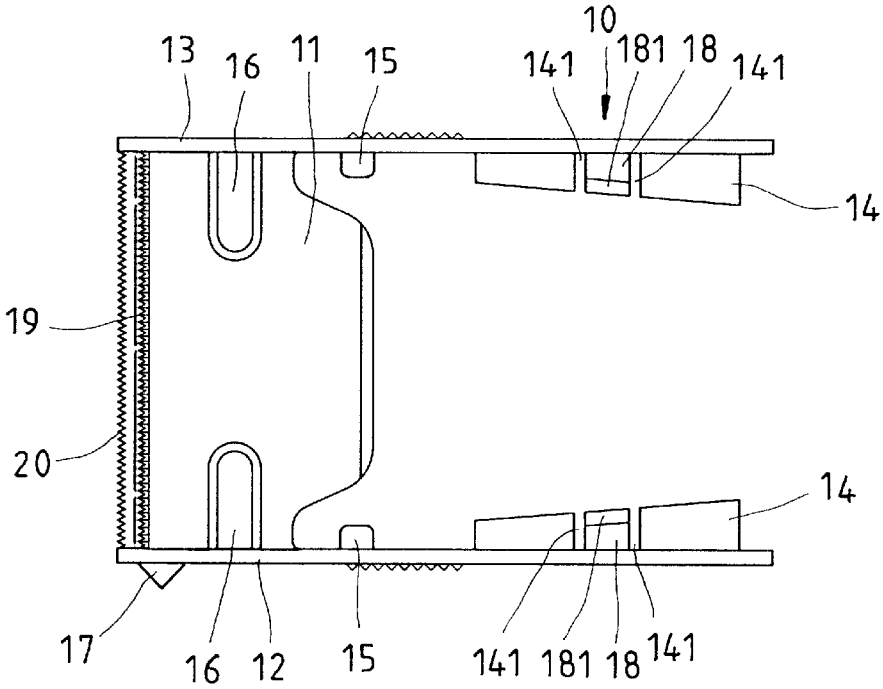
FIG. 3 is a top view of the preferred embodiment of the present invention.
Figure 4:
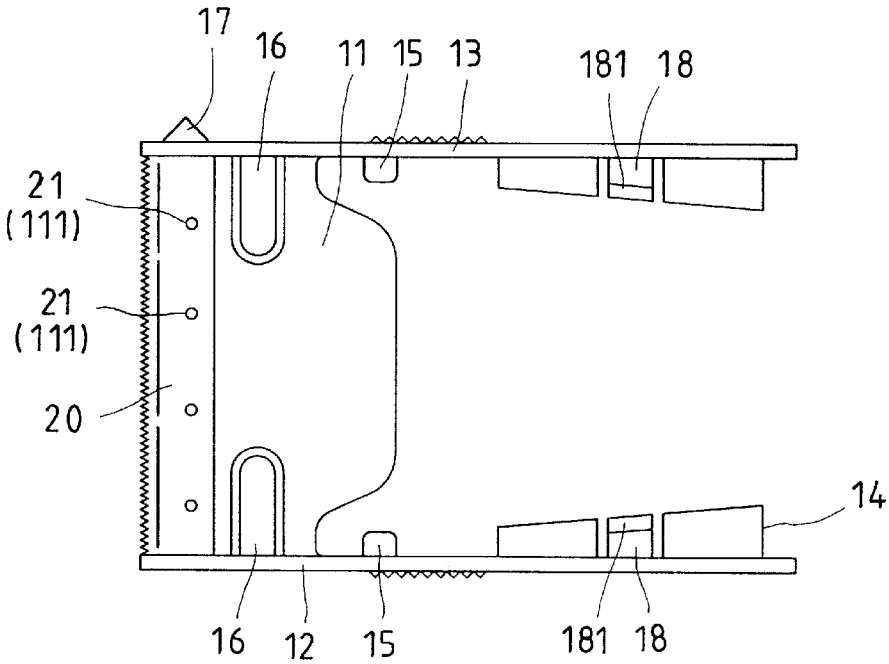
FIG. 4 is a bottom view of the preferred embodiment of the present invention.
Figure 5:
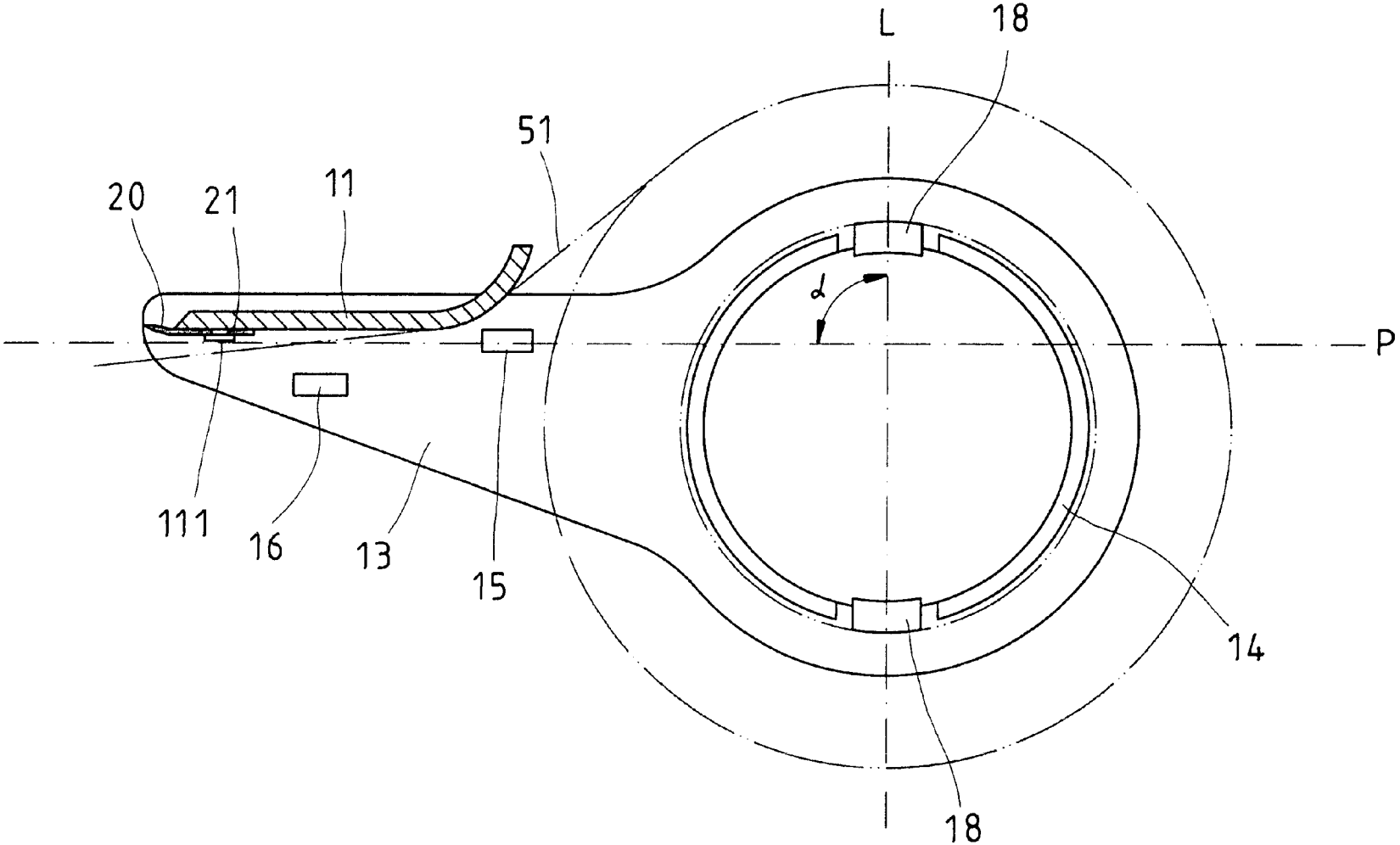
FIG. 5 is a sectional view taken along line 5—5 in FIG. 2.

In use, please refer to FIG. 2, a tape roll 50 is installed between the side arms and insert the roll mounts 14 into the central hole of the tape roll 50 such that tape 51 of the tape roll can be drawn out to run trough a tunnel between the guiding pieces 15 and 16 and the connecting board 11 and extrude out of the cutter 20.

Figure 6:
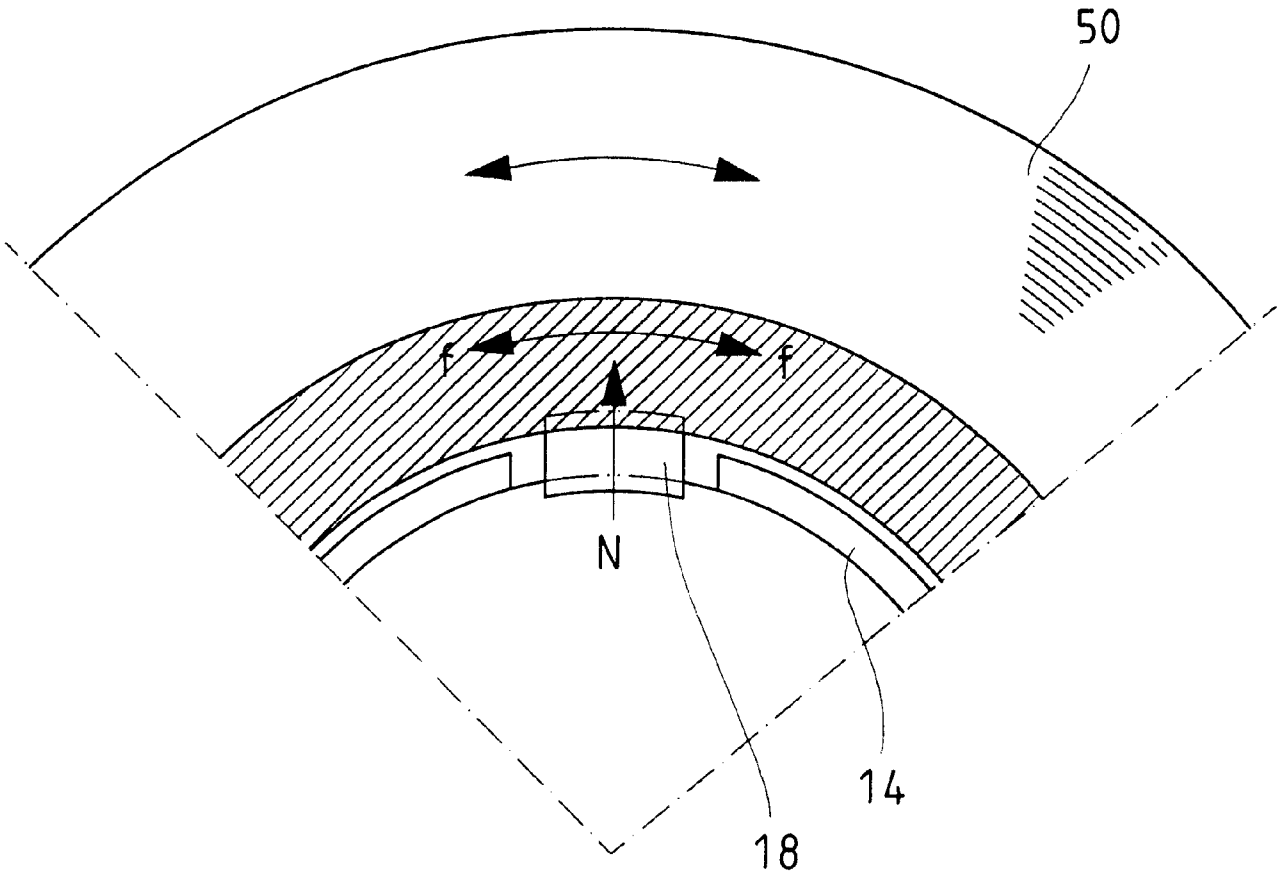
FIG. 6 is an enlarged view in part of FIG. 5.

Please refer to FIGS. 2 and 6, wherein the tape roll 50 mounted on the tape dispenser of the present invention will press the blocks 181 to make the stop arms 18 bent. A normal force N occurs between the stop arms 18 and the tape roll 50 such that it will provide a friction f. User has to exert the tail of the tape 51 to overcome the friction f, thus, he/she can draw the tape 51 out. As shown in at least FIG. 6, the stop arm 18 has a free end (block 181) that presses the tape roll 50 with an elastic normal force N that is substantially perpendicular to the rotating axis of the tape roll 50 to provide friction to the tape roll 50.

The friction f, however, also will stop the tape roll 50 running backwards under the unexpected situations, such as the tension of the tape 51 when it is cut off, the weight of the tape roll 50 or exerted by exterior force which will make the tape roll 50 running backwards. Such that the tail of the tape 51 will stay on connecting board 11 to facilitate next time use.

The strength of the friction f provided by the stop arms 18 is depended on several factors, such as the size, material and numbers of the stop arms 18 and the height of the blocks 181. The friction f can not too strong, it will make the tape 51 hard to be drawn out. But, if the friction f is weak, the tape roll 50 still has chance to run backwards unexpectedly.

The locations of the stop arms 18 have better place to be disposed. Please refer to FIG. 5 line L is a line passing through the stop arm 18 and the center of the roll mount 14 and line P is a line parallel to the plane of the connecting board 11. The included angle $\alpha$ of the line L and line P is better within a range of 45 degrees to 135 degrees. The stop arms 18 of the present invention are located at the positions where the angle $\alpha$ is 90 degrees. If the stop arms 18 are located at the position out of the range, the tape roll might be self-locked when draw the tape 181 out.

It also can be just disposed with a saw portion 19 at the front edge of the connecting board 11 to replace the cutter 20 to cut the tape 51 off.

What is claimed is:

1. A tape dispenser, comprising:

a main body having a connecting board, two side arms at opposite ends of said connecting board respectively and two roll mounts at interior sides of said side arms respectively for installing a tape roll between said side arms and inserting said roll mounts into a central hole of the tape roll;

said roll mounts provided with at least a stop arm extended substantially parallel to the rotating axis of the tape roll mounted to said roll mounts, said stop arm has a free end that presses the tape roll with an elastic normal force that is substantially perpendicular to the rotating axis of the tape roll to provide friction to the tape roll; and a cutter for cutting a tape of the tape roll.

2. A tape dispenser as claimed in claim 1, wherein said stop arm is provided with a block.

3. The tape dispenser as claimed in claim 1, wherein said cutter is mounted on said connecting board to cut the tape of the tape roll.

4. The tape dispenser as claimed in claim 3, wherein said connecting board is provided with pins to insert them into openings on said cutter, and distal ends of said pins are deformed to secure said cutter on said connecting board.

5. The tape dispenser as claimed in claim 1, wherein an included angle between the line passing through said stop arm at the center of said roll mount and a plane parallel to said connecting board is within a range of 45 degrees to 135 degrees.

6. The tape dispenser as claimed in claim 5, wherein said included angle is about 90 degrees.

7. A tape dispenser comprising:

a main body having a connecting board, two side arms at opposite ends of said connecting board respectively and two roll mounts at interior sides of said side arms respectively for installing a tape roll between said side arms and inserting said roll mounts into a central hole of the tape roll;

said roll mounts provided with at least a stop arm extended substantially parallel to the rotating axis of the tape roll, which has a free end to be pressed by the tape roll to provide a friction to the tape roll;

a cutter for cutting a tape of the tape roll; and wherein said roll mount is provided with gaps, said stop arm is formed at between two of said gaps.

8. The tape dispenser as claimed in claim 7, wherein said stop arm is provided with a block.

9. The tape dispenser as claimed in claim 7, wherein said cutter is mounted on said connecting board to cut the tape of the tape roll off.

10. The tape dispenser as claimed in claim 9, wherein said connecting board is provided with pins to insert them into openings on said cutter, and distal ends of said pins are deformed to secure said cutter on said connecting board.

11. The tape dispenser as claimed in claim 7, wherein an included angle between a line passing through said stop arm and the center of said roll mount and a plane parallel to said connecting board is within a range of 45 degrees to 135 degrees.

12. The tape dispenser as claimed in claim 11, wherein said included angle is about 90 degrees.

* * * * *